US009427992B2

(12) United States Patent
Thayer

(10) Patent No.: US 9,427,992 B2
(45) Date of Patent: Aug. 30, 2016

(54) SYSTEM AND METHOD FOR LEAD EDGE RELEASE COATING FOR IMPROVED MEDIA STRIPPING IN AN AQUEOUS INKJET PRINTER

(71) Applicant: Xerox Corporation, Norwalk, CT (US)

(72) Inventor: Bruce E. Thayer, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/562,873

(22) Filed: Dec. 8, 2014

(65) Prior Publication Data

US 2016/0159120 A1 Jun. 9, 2016

(51) Int. Cl.
*B41F 7/24* (2006.01)
*B41J 25/00* (2006.01)

(52) U.S. Cl.
CPC ..... *B41J 25/001* (2013.01)

(58) Field of Classification Search
USPC ..... 347/103, 223
See application file for complete search history.

(56) References Cited

U.S. PATENT DOCUMENTS 6,327,447 B1 * 12/2001 Nakano ..... G03G 15/2003 399/92
6,682,189 B2 * 1/2004 May ..... B41J 2/01 347/103
6,684,048 B2 1/2004 Caruthers et al.
6,714,229 B2 * 3/2004 Miyazaki ..... B41J 29/377 347/223
7,281,790 B2 * 10/2007 Mouri ..... B41J 2/0057 347/102
7,419,257 B2 * 9/2008 Mouri ..... B41J 2/0057 347/102
7,661,809 B2 * 2/2010 Taniuchi ..... B41J 2/0057 347/101
8,002,400 B2 * 8/2011 Kibayashi ..... B41J 2/0057 347/101
8,011,781 B2 * 9/2011 Taniuchi ..... B41J 2/0057 347/101
8,038,284 B2 * 10/2011 Hori ..... B05C 1/0817 347/101
8,109,626 B2 * 2/2012 Doi ..... B41J 2/0057 347/103
8,136,936 B2 * 3/2012 Hook ..... B41M 1/06 347/101
8,162,472 B2 * 4/2012 Williamson ..... B41J 11/0015 347/103
8,177,351 B2 * 5/2012 Taniuchi ..... B41J 2/0057 347/10
8,220,917 B2 7/2012 Taniuchi et al.
8,328,349 B2 * 12/2012 Hook ..... B41M 1/06 101/450.1
8,496,326 B2 * 7/2013 Hook ..... B41M 1/06 347/101
8,500,269 B2 * 8/2013 Morita ..... B41J 2/0057 347/103
8,746,873 B2 * 6/2014 Tsukamoto ..... B41J 2/0057 347/100
8,894,198 B2 * 11/2014 Hook ..... B41M 1/06 347/100
9,021,949 B2 * 5/2015 Biegelsen ..... B41C 1/10 101/148
9,056,495 B2 * 6/2015 Mizes ..... B41J 11/0015
2002/0054197 A1 * 5/2002 Okada ..... B41J 2/01 347/101
2005/0110856 A1 * 5/2005 Mouri ..... B41J 2/0057 347/103
2013/0199387 A1 * 8/2013 Biegelsen ..... B41C 1/10 101/148
2014/0168304 A1 6/2014 Mizes et al.

* cited by examiner

*Primary Examiner* — Matthew Luu
*Assistant Examiner* — Lily Kemathe
(74) *Attorney, Agent, or Firm* — Maginot Moore & Beck LLP

(57) ABSTRACT

An inkjet printer is configured to apply a coating material to the lead edge of an imaging surface after an ink image is formed on the surface. A controller determines the amount and location of coating material applied to the lead edge based on the stiffness or thickness of the media printed on, and based on image content.

18 Claims, 4 Drawing Sheets

SYSTEM AND METHOD FOR LEAD EDGE RELEASE COATING FOR IMPROVED MEDIA STRIPPING IN AN AQUEOUS INKJET PRINTER

TECHNICAL FIELD

This disclosure relates generally to indirect inkjet printers, and, in particular, to surface preparation for inkjet printing.

BACKGROUND

In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface. When aqueous ink is ejected directly onto media, the aqueous ink tends to soak into the media when it is porous, such as paper, and change the physical properties of the media. To address this issue, indirect printers have been developed that eject a skin layer onto the blanket mounted to a drum or endless belt, and an ink layer onto the skin layer. The ink is dried on the skin layer and then transferred to media. Such a printer avoids the changes in media properties that occur in response to media contact with the water or solvents in aqueous ink. Indirect printers also reduce the effect of variations in other media properties that arise from the use of widely disparate types of paper and films used to hold the final ink images.

In these indirect printers, media stripping may be a problem. Both the skin and the ink layer must adhere to the media so that the image is transferred to the media. However, high adhesion also makes stripping the media and ink image from the blanket difficult, particularly when relatively thin media are used. Air knives have been proposed to aid in media stripping in the past. Insufficient media lead edge separation from the blanket usually prevents an air knife from successfully stripping the media from the blanket. Stripper fingers have also been proposed for this purpose, but they must be pressed into the blanket with high pressures in order to strip the lead edge of the media from the blanket. Such high pressures increase the wear and reduce the life of the blanket. Other ways of successfully stripping media from a blanket in an inkjet printer without adversely affecting the blanket surface would be beneficial.

SUMMARY

A printer has been developed that facilitates media lead edge separation from a blanket in an inkjet printer to enable removal of the media from the blanket without decreasing the life of the blanket. The printer includes at least one printhead configured to eject liquid ink, a rotating member being positioned to rotate past the at least one printhead to enable the at least one printhead to eject liquid ink and form an ink image, a first applicator positioned with reference to the rotating member to apply a first material to a surface of the rotating member to enable the ink image to be formed on a surface of the first material on the surface of the rotating member by the at least one printhead, a second applicator position with reference to the rotating member to apply a second material on a portion of the first material after the ink image has been formed on the surface of the first material, a transfer roller configured to move into and out of engagement with the rotating member to form a nip selectively with the rotating member, and a controller operatively connected to the printhead, the first applicator, the second applicator, and the transfer roller, the controller being configured to operate the first applicator to apply the first material to the rotating member, to operate the second applicator to apply the second material to the portion of the first material on the surface of the rotating member, and to move the transfer roller into engagement with the rotating member to form the nip with the rotating member as the second material on the portion of the first material approaches the nip and as media approaches the nip to enable a leading edge of the media to engage the second material on the portion of the first material in the nip and facilitate separation of the leading edge of the media from the first material on the surface of the rotating member after the media exits the nip.

A method of operating a printer has been developed that facilitates media lead edge separation from a blanket in an inkjet printer to enable removal of the media from the blanket without decreasing the life of the blanket. The method includes operating with a controller a first applicator positioned with reference to a rotating member to apply a first material to a surface of the rotating member, operating with the controller inkjets in at least one printhead positioned with reference to the rotating member to eject ink on a surface of the first material to form an ink image, operating with the controller a second applicator positioned with reference to the rotating member to apply a second material on a portion of the surface of the first material after the ink image has been formed on the surface of the first material, and operating with the controller a transfer roller to move into and out of engagement with the rotating member to form a nip selectively with the rotating member as the second material on the portion of the surface of the first material approaches the nip and as media approaches the nip to enable a leading edge of the media to engage the second material on the portion of the surface of the first material in the nip and facilitate separation of the leading edge of the media from the first material on the surface of the rotating member after the media exits the nip.

DETAILED DESCRIPTION

Figure 1:
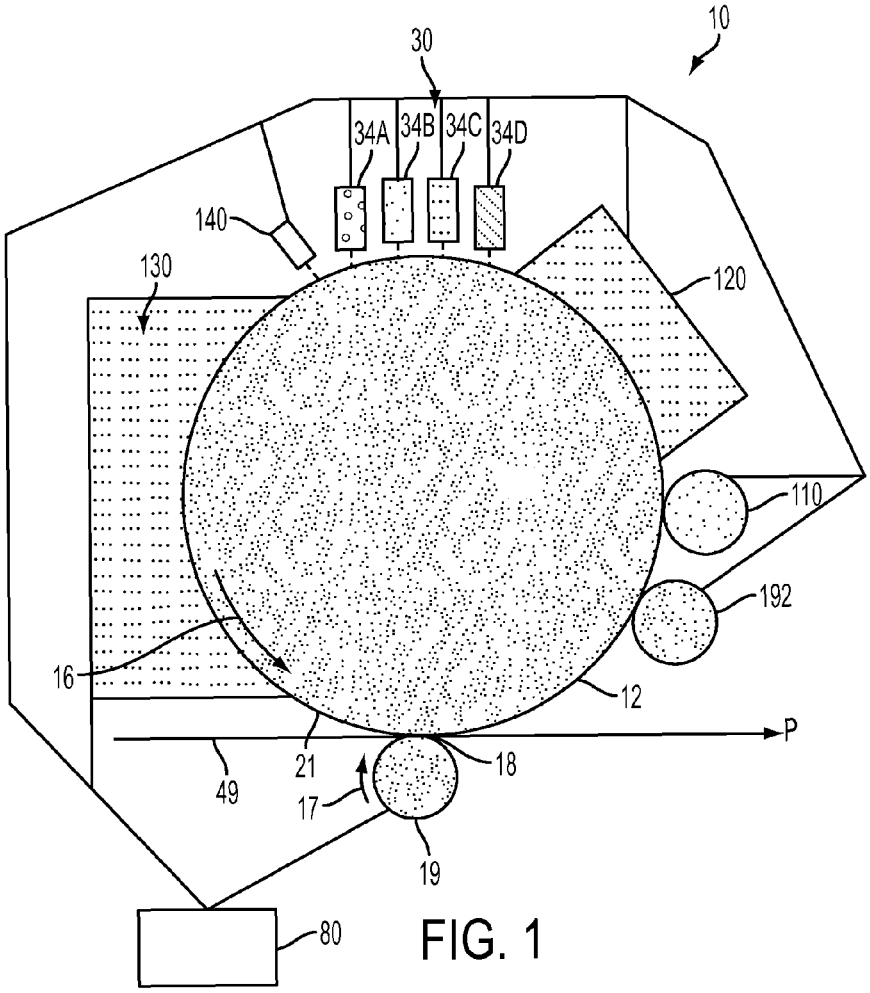
FIG. 1 is a partial schematic of an aqueous indirect inject printer that produces images on sheet media.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. As used in this document, the term "aqueous ink" includes liquid inks in which colorant is in solution with water and/or one or more solvents.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

FIG. 1 illustrates a high-speed aqueous ink image producing machine or printer 10. Although the description of the system and method for lead edge release coating for improved media stripping is directed to an aqueous inkjet printer, the reader should appreciate that the system and method can be used in other liquid inkjet printers. Additionally, while printer 10 is described below as printing to sheet media, the reader should understand that subsystem that facilitates the stripping of media from the blanket on which an ink image is printed can be used in a printer that passes media as a web pulled from a supply roll through the transfer nip and rewound on a take-up roller for later processing. As illustrated, the printer 10 is an indirect printer that forms an aqueous ink image on a surface of a blanket 21 mounted about a receiving member 12 and then transfers the ink image to media 49 passing through a nip 18 formed with the blanket 21 and transfix roller 19. The printer 10 includes a frame 11 that supports directly or indirectly operating subsystems and components, which are described below. The receiving member 12 is shown in the form of a drum, but can also be configured as a supported endless belt. The receiving member 12 has an outer blanket 21 mounted about the circumference of the member 12. The blanket moves in direction 16 as the receiving member 12 rotates. Transfix roller 19 is rotatable in direction 17 and is loaded against the surface of blanket 21 to form the transfix nip 18, within which ink images formed on the surface of blanket 21 are transfixed onto media sheet 49.

The blanket is formed of a material having a relatively low surface energy to facilitate transfer of the ink image from the surface of the blanket 21 to the media sheet 49 in the nip 18. Such materials include silicones, fluro-silicones, Viton, and the like. A surface maintenance unit (SMU) 192 removes residual ink left on the surface of the blanket 21 after the ink images are transferred to the media sheet 49. The SMU 192 has a cleaning blade that is selectively moved to remove un-transferred ink pixels from the surface of the blanket 21. The SMU 192 is operatively connected to a controller 80, described in more detail below, to enable the controller to operate the cleaning blade selectively. In some embodiments, instead of a cleaning blade, SMU 192 has an air knife to clean the surface of the blanket selectively. In other embodiments, SMU 192 instead uses stripper fingers. Any known stripping mechanism may be implemented into SMU 192 to clean the blanket from residuals.

The low energy surface of the blanket does not aid in the formation of good quality ink images because such surfaces do not spread ink drops as well as high energy surfaces. Consequently, a first coating applicator 110 applies a coating to the blanket surface. The coating helps aid in wetting the surface of the blanket, inducing solids to precipitate out of the liquid ink, providing a solid matrix for the colorant in the ink, and aiding in the release of the ink image from the blanket. Such coatings include surfactants, starches, and the like.

The first coating applicator 110 includes a reservoir (not shown) with a fixed volume of coating material and a donor roller, which can be smooth or porous and is rotatably mounted in the reservoir for contact with the coating material. The donor roller can be an elastomeric roller or a rigid roller such as an anilox roller. The coating material is applied to the surface of the blanket 21 to form a thin layer on the blanket surface. The first coating applicator 110 is operatively connected to a controller 80, described in more detail below, to enable the controller to move the donor roller selectively.

Figure 2:
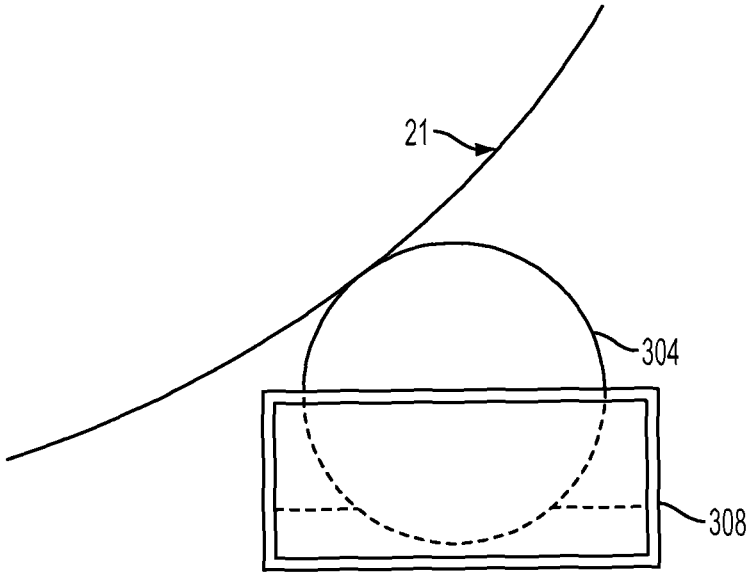
FIG. 2 is a schematic diagram of a device that uses contact to apply coating material to an imaging surface.
Figure 3:
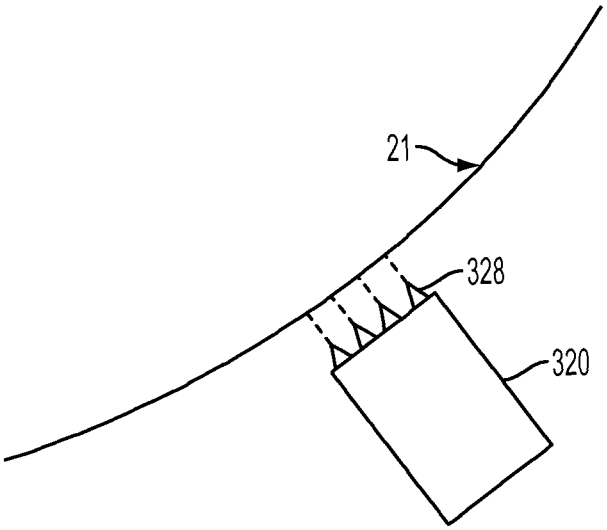
FIG. 3 is a schematic diagram of a device that ejects drops of coating material onto an imaging surface.

As shown in FIG. 2, the first coating applicator 110 can include a donor roller applicator 304. The roller applicator 304 can be partially immersed in a reservoir 308 of the coating material to enable the roller to pick up the coating material and apply it to the surface of the blanket 21. Although the applicator 100 has been described as having a donor roller and reservoir, in another embodiment shown in FIG. 3, the applicator instead includes an applicator head 320 having a plurality of nozzles 328 through which the coating material is ejected in a mist to form a discontinuous film of very small drops onto the blanket surface. The size of the drops would be much smaller than the size of ink drops ejected by the printheads 34A to 34D, which are described in more detail below. The drops can contain compounds that induce solids in the ink to precipitate out of solution. A discontinuous film can be advantageously used with blanket surfaces having very low surface energy since liquid films, such as those produced by a roller applicator, tend to break up on low surface energy materials. If a liquid coating film breaks up then some ink drops land on the coating while other ink drops land directly on the blanket. Consequently, the applicator head is configured to produce a significant number of coating drops on the blanket for every ink drop and to distribute the drops evenly. If too few drops are ejected, the ink drops do not interact with an adequate number of drops. If too many drops are ejected, then the drops agglomerate into larger pools that may affect the uniformity of the printed surface. When a discontinuous film of the coating is used on the imaging surface, the "thickness" of the coating refers to an average thickness of the coating drops on the imaging surface.

Printer 10 also includes a dryer 120 configured to dry the first coating applied to the blanket by the first coating applicator 110. The controller 80 operates a fan and heater within the dryer to control the amount of airflow and heat of the air directed by the dryer 120 towards the first coating on the blanket.

The high-speed aqueous ink printer 10 also includes a plurality of printhead modules, also known as print box units, 34A through 34D. Each printhead module 34A-34D effectively extends across the width of the blanket and ejects ink drops onto the surface of the blanket 21. A printhead module can include a single printhead or a plurality of printheads configured in a staggered arrangement. Each printhead module is operatively connected to a frame (not shown) and aligned to eject the ink drops to form an ink image on the coating on the blanket surface. The printhead modules 34A-34D can include associated electronics, ink reservoirs, and ink conduits to supply ink to the one or more printheads. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

As shown in FIG. 1, printer 10 also includes a second coating applicator 140. The second coating applicator 140 includes one or more ejectors (not shown) and is operatively connected to controller 80 to enable the controller to operate the ejectors to eject a lead edge release coating on the lead edge of the image surface of the blanket 21, as described in more detail below. The lead edge release coating is a release film fluid that, when dried, produces a low adhesion film on the surface of the blanket 21. In one embodiment, the release film fluid is a solution of polyvinyl acetate and water. Other release film fluids can be used. Such fluids are capable of application by ejection, drying, and having low adhesion to media and are capable of being removed easily from the blanket with a cleaning solution. The film enables the ink image to transfer to media 49 when the roller 19 is loaded against the surface of the blanket 21 to form transfix nip 18 and then allows the lead edge of the media to separate from the blanket 21 without an outside agency intervening between the two surfaces as the lead edge exits the nip.

Printer 10 includes a dryer 130 configured to dry the lead edge release coating applied by the coating applicator 140. The image dryer 130 includes an infrared heater, a heated air source, and air returns (not shown). The infrared heater applies infrared heat to the printed image and the lead edge release coating on the surface of the blanket 21 to evaporate water in the coating as well as water and solvent in the ink. The heated air source directs heated air over the ink to supplement the evaporation of the water or solvent from the ink. The air is then collected and evacuated by air returns and to reduce the interference of the air flow with other components in the printing area.

Operation and control of the various subsystems, components and functions of the machine or printer 10 are performed with the aid of a controller or electronic subsystem (ESS) 80. The ESS or controller 80 is operably connected to the SMU 192, the first coating applicator 110, the dryer 120, the printhead modules 34A-34D, the second coating applicator 140, the dryer 130, receiving member 12, and transfix roller 19. The ESS or controller 80, for example, is a self-contained, dedicated mini-computer having a central processor unit (CPU) with electronic storage, and a display or user interface (UI). The ESS or controller 80, for example, includes a sensor input and control circuit as well as a pixel placement and control circuit. In addition, the CPU reads, captures, prepares and manages the image data flow between image input sources, such as a scanning system, or an online or a work station connection, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, controller 80 sends signals to the first applicator 110 to eject a first coating to the surface of the blanket 21. As discussed above, the coating helps aid in wetting the surface of the blanket, inducing solids to precipitate out of the liquid ink, providing a solid matrix for the colorant in the ink, and aiding in the release of the ink image from the blanket. The controller 80 also send signals to the dryer 120 to control airflow from dryer 120 towards the blanket 21, to dry the first coating on the surface of the blanket 21. Image data for an image to be produced are sent to the controller 80 from either a scanning system or via the online or work station 90 for processing and generation of the printhead control signals output to the printhead modules 34A-34D. Additionally, the controller 80 determines and/or accepts related subsystem and component controls, for example, from operator inputs via the user interface, and accordingly executes such controls. As a result, aqueous ink for appropriate colors are delivered to the printhead modules 34A-34D. Additionally, pixel placement control is exercised relative to the blanket surface to form ink images corresponding to the image data, and the media, which can be in the form of media sheets 49, and handled by a recording media transport system for timed delivery to the nip 18. In the nip 18, the ink image is transferred from the blanket and coating 21 to the media substrate within the transfix nip 18.

In some printing operations, a single ink image can cover the entire surface of the blanket 21 (single pitch) or a plurality of ink images can be deposited on the blanket 21 (multi-pitch). In a multi-pitch printing architecture, the surface of the image receiving member can be partitioned into multiple segments, each segment including a full page image in a document zone (i.e., a single pitch) and inter-document zones that separate multiple pitches formed on the blanket 21. For example, a two pitch image receiving member includes two document zones that are separated by two inter-document zones around the circumference of the blanket 21. Likewise, for example, a four pitch image receiving member includes four document zones, each corresponding to an ink image formed on a single media sheet, during a pass or revolution of the blanket 21.

Once an ink image or images have been formed on the first coating on the surface of the blanket under by the printheads under control of the controller 80, the controller 80 causes the second coating applicator 140 to eject release film fluid at the lead edge of the print. The release film fluid has low adhesive strength, which enables the lead edge of media to be more easily stripped from the blanket following image transfer to the media in the nip. In most cases, the lead edge of the media separates from the blanket as it exits the nip without the need of a blade or stripper fingers that may damage or prematurely wear the blanket over time. The location and amount of release film fluid ejected to the blanket by the second coating applicator 140 may be determined by the controller 80 based on the several factors, including the stiffness and/or thickness of media 49 to which the ink image is transferred and the image data.

Figure 4:
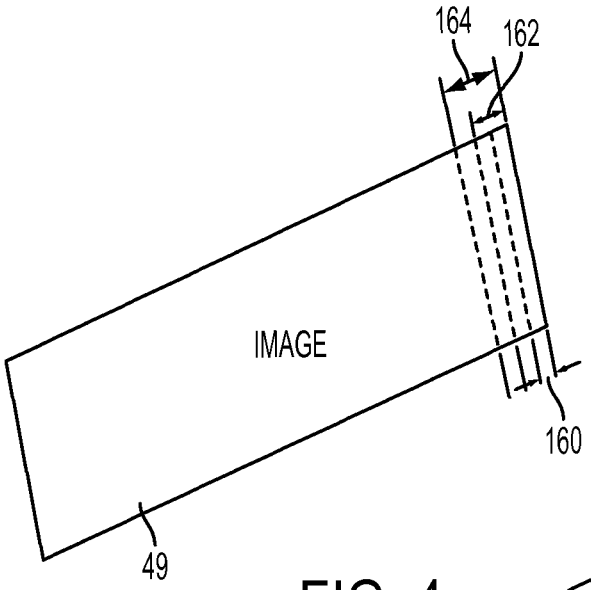
FIG. 4 is a perspective view of a media sheet with lead edge release coating from a coating applicator.
Figure 5:
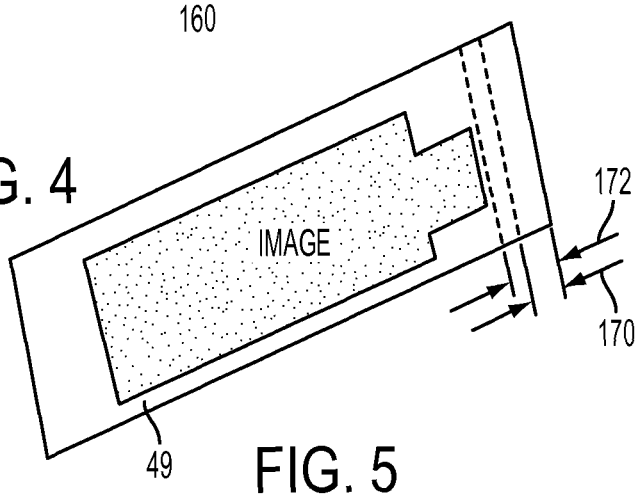
FIG. 5 is a perspective view of another media sheet with lead edge release coating from a coating applicator.
Figure 6:
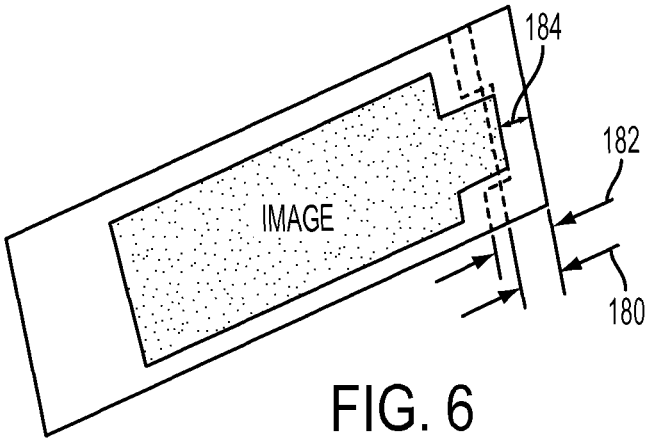
FIG. 6 is a perspective view of another media sheet with lead edge release coating from a coating applicator.

FIGS. 4-6 show strips of release film on media 49, originating from the release film fluid ejected onto blanket 21 and transferred to media 49. In a first operation, controller 80 determines the proper minimum width of a strip of release film fluid to be ejected by coating applicator 140 that results in self-stripping of the ink to the media 49 based on the thickness or stiffness of media 49 used in a printing operation measured from the leading edge of the media to the start of the printed image. Generally, stiff media may self-strip and need no release film, or only a strip of release film having a relatively small width. Thinner, less stiff media may require a strip of release film having a relatively large width in order to ensure that the ledge edge self-strips and is transferred properly to the media 49. Width as meant in this context refers to the distance between the leading edge that extends towards the printed ink image. FIG. 4 shows three minimum widths 160, 162, 164 of strips of release film applied by the applicator 140 measured from the leading edge of the media in a direction towards the image content, each width 160, 162, 164 associated with a media 49 having a different stiffness or thickness. Width 160 is the smallest of the three widths 160, 162, 164, and is the minimum width for the thickest or stiffest media 49 of the three strips shown. Width 164 is the largest and is the minimum coating width for media having the least thickness or stiffness. Width 162 is between the width 160 and the width 164, and represents the minimum width of release film that should be applied to media having a thickness or stiffness value between the media associated with widths 160 and 164.

Controller 80 is also programmed to take into consideration image data when determining the width of the strip of release film ejected by coating applicator. In a second operation, controller 80 is configured to determine the maximum thickness of the width of the strip to be applied by the coating applicator 140 based on image data, measured as the distance from the leading edge of the media receiving the image to the leading edge of the ink image. Application of the film from the leading edge of the media 49 in excess of the minimum width up to the image content increases the ability of the media to strip from the blanket 21, but application of the film over the image content would cover the image content, and prevent its transfer to the media. As shown in FIG. 5, the minimum width 170 is shown based on the stiffness or thickness of media 49, as discussed above. In addition, the maximum width 172 is shown in excess of the minimum width and up to a lead edge of the image content. In such a case, applying the release film beyond the minimum width 170 to the maximum width 172 at the beginning of the image content would assist in stripping without covering up image content.

As shown in FIG. 6, the minimum width 180 determined by controller 80 based on the stiffness or thickness of media 49 exceeds the beginning of the image content at least for part of the image data. Application of the release film over the image content would cover the image content and prevent proper transfer to the media 49, so the controller 80 instead causes release film to form around and conform to the leading edge of the image content, as indicated by the variable widths 182 and 184. In this case, the release film is optimized for image shape to help with stripping at the corners of the media, which enables stripping in the image area as well. Controlling the controller 80 to conform to the image as shown in FIG. 6 is not limited to situations where the minimum width of the release film based on the stiffness or thickness of the media exceeds the beginning of the image content. Ejecting the release film fluid to conform to the image is equally applicable to other printing scenarios, including that shown in FIG. 5, where the minimum width 170 does not exceed the image content. That is to say the controller 80 can cause applicator 140 to eject release film to conform around the lead edge of the image content shown in FIG. 5 as well.

Printer 10 transfers and fixes the image or images from the blanket surface to media in the printer 10 with controller 80 operating actuators to drive one or more of the rollers to move the media sheet 49 to a position adjacent the transfix roller 19 and then through the transfix nip 18 between the transfix roller 19 and the blanket 21. The transfix roller 19 applies pressure against the back side of the recording media 49 in order to press the front side of the recording media 49 against the blanket 21 and the receiving member 12. The pressure produced by the transfix roller 19 on the back side of the heated media sheet 49 facilitates the transfixing (transfer and fusing) of the image from the receiving member 12 onto the media sheet 49.

The rotation or rolling of both the receiving member 12 and transfix roller 19 not only transfixes the images onto the media sheet 49, but also assists in transporting the media sheet 49 through the nip. The receiving member 12 continues to rotate to continue the transfix process for the images previously applied to the coating and blanket 21.

Figure 7:
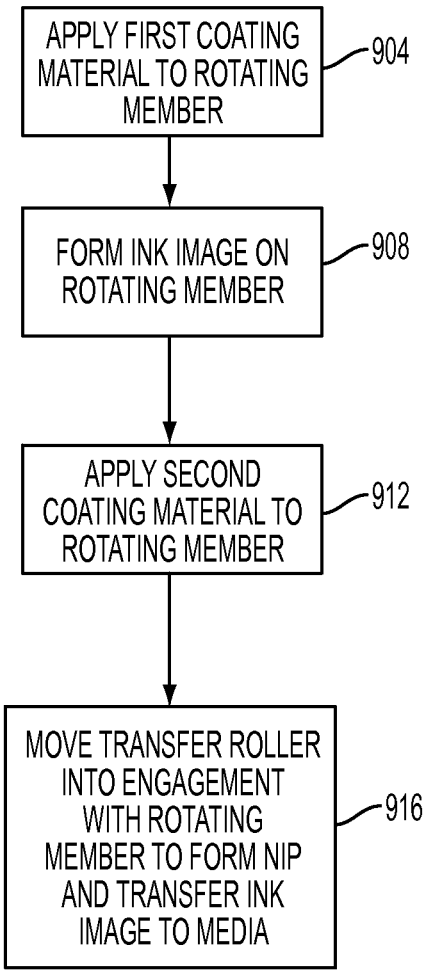
FIG. 7 is a flow diagram of a method of operating a printer that uses a lead edge release coating on an imaging surface.

A method of printer operation that monitors the application of a coating to a rotating surface is shown in FIG. 7. In the description of the method, a statement that the process is performing some function refers to a processor or controller executing programmed instructions stored in a memory operatively connected to the processor or controller to operate one or more printer components to perform the function. In the process, a first coating material is applied to the surface of the rotating member (block 904). The coating material can be applied either by a contact applicator, such as a roller, or by a liquid drop or dry particle applicator as described above. After the first coating is applied, firing signals are delivered to the printheads to eject aqueous ink onto the layer of first coating material on the surface of the rotating member to form an aqueous ink image on the layer of first coating material on the surface of the rotating member surface (block 908). After the aqueous ink image is formed, a second coating material is applied to the layer of first coating material on the surface of the rotating member after the aqueous ink image is formed on the surface of the rotating member by the at least one printhead (block 912). A transfer roller moves into engagement with the rotating member to form a nip with the rotating member as the second material on the portion of the surface of the first material approaches the nip and as media approaches the nip to enable a leading edge of the media to engage the second material on the portion of the surface of the first material in the nip and facilitate separation of the leading edge of the media from the first material on the surface of the rotating member after the media exits the nip (block 916).

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

at least one printhead configured to eject liquid ink;

a rotating member being positioned to rotate past the at least one printhead to enable the at least one printhead to eject liquid ink and form an ink image;

a first applicator positioned with reference to the rotating member to apply a first material to a surface of the rotating member to enable the ink image to be formed on a surface of the first material on the surface of the rotating member by the at least one printhead;

a second applicator position with reference to the rotating member to apply a second material on a portion of the first material on which no portion of the ink image was formed after the ink image has been formed on the surface of the first material;

a transfer roller configured to move into and out of engagement with the rotating member to form a nip selectively with the rotating member; and a controller operatively connected to the printhead, the first applicator, the second applicator, and the transfer roller, the controller being configured to operate the first applicator to apply the first material to the rotating member, to operate the second applicator to apply the second material to the portion of the first material on the surface of the rotating member on which no portion of the ink image was formed, and to move the transfer roller into engagement with the rotating member to form the nip with the rotating member as the second material on the portion of the first material approaches the nip and as media approaches the nip to enable a leading edge of the media to engage the second material on the portion of the first material not having any portion of the ink image in the nip before the ink image enters the nip to facilitate separation of the leading edge of the media from the rotating member after the media exits the nip.

2. The printer of claim 1, the controller being further configured to:

vary a length of the portion of the first material to which the second material is applied for different ink images formed on the first material on the surface of the rotating member.

3. The printer of claim 2, the controller being further configured to:

vary the length of the portion of the first material to which the second material is applied with reference to a type of media to pass through the nip.

4. The printer of claim 2, the controller being further configured to:

vary the length of the portion of the first material to which the second material is applied with reference to image data used to form the ink image.

5. The printer of claim 1 wherein the second applicator is another printhead; and the controller is further configured to operate the other printhead to apply the second material to the portion of the first material on the surface of the rotating member.

6. The printer of claim 5 further comprising:

a reservoir of the second material is operatively connected to the printhead and the second material is a polyvinyl acetate solution.

7. The printer of claim 5 wherein the other printhead has a resolution that is less than the at least one printhead that ejects liquid ink.

8. The printer of claim 1 further comprising:

a dryer positioned with reference to the rotating member to dry at least one of: (i) the second material applied to the portion of the first material on the surface of the rotating member; (ii) and ink ejected onto the first material applied to the surface of the rotating member.

9. The printer of claim 1 further comprising:

a surface maintenance unit positioned to engage the surface of the rotating member after the surface of the rotating member has passed through the nip with the transfer roller, the surface maintenance unit being configured to remove from the surface of the rotating member at least one of (i) the first material; (ii) ink ejected onto the first material by the at least one printhead; and (iii) the second material applied to the portion of the first material by the second applicator.

10. A method of printer operation comprising:

operating with a controller a first applicator positioned with reference to a rotating member to apply a first material to a surface of the rotating member;

operating with the controller inkjets in at least one printhead positioned with reference to the rotating member to eject ink on a surface of the first material to form an ink image;

operating with the controller a second applicator positioned with reference to the rotating member to apply a second material on a portion of the surface of the first material not having any portion of the ink image after the ink image has been formed on the surface of the first material; and operating with the controller a transfer roller to move into and out of engagement with the rotating member to form a nip selectively with the rotating member as the second material on the portion of the surface of the first material approaches the nip and as media approaches the nip to enable a leading edge of the media to engage the second material on the portion of the surface of the first material not having any portion of the ink image in the nip before the ink image enters the nip to facilitate separation of the leading edge of the media from the rotating member after the media exits the nip.

11. The method of printer operation of claim 10 further comprising:

operating the second applicator with the controller to vary a length of the portion of the first material to which the second material is applied for different ink images formed on the first material on the surface of the rotating member.

12. The method of printer operation of claim 11 further comprising:

operating the second applicator with the controller to vary the length of the portion of the first material to which the second material is applied with reference to a type of media to pass through the nip.

13. The method of printer operation of claim 11 further comprising:

operating the second applicator with the controller to vary the length of the portion of the first material to which the second material is applied with reference to image data used to form the ink image.

14. The method of printer operation of claim 10, the operation of the second applicator further comprising:

operating another printhead with the controller to apply the second material to the portion of the first material on the surface of the rotating member.

15. The method of printer operation of claim 14, the operation of the other printhead further comprising:

operating the other printhead to eject drops of a polyvinyl acetate solution as the second material onto the portion of the first material on the surface of the rotating member.

16. The method of printer operation of claim 14, the operation of the other printhead further comprising:

operating the other printhead to eject drops of the second material at a resolution that is less than a resolution at which the at least one printhead ejects liquid ink.

17. The method of printer operation of claim 10 further comprising:

operating with the controller a dryer positioned with reference to the rotating member to dry at least one of: (i) the second material applied to the portion of the first material on the surface of the rotating member; (ii) and ink ejected onto the first material applied to the surface of the rotating member.

18. The method of printer operation of claim 10 further comprising:

operating with the controller a surface maintenance unit to engage the surface of the rotating member after the surface of the rotating member has passed through the nip with the transfer roller to remove from the surface of the rotating member at least one of (i) the first material; (ii) ink ejected onto the first material by the at least one printhead; and (iii) the second material applied to the portion of the first material by the second applicator.

* * * * *